US008677696B2

(12) United States Patent
Ryan

(10) Patent No.: US 8,677,696 B2
(45) Date of Patent: Mar. 25, 2014

(54) FIXING SYSTEM AND METHOD

(75) Inventor: Brad Stewart Ryan, Marshall Mount (AU)

(73) Assignee: Bluescope Steel Limited, Melbourne (AU)

( * ) Notice: Subject to any disclaimer, the term of this patent is extended or adjusted under 35 U.S.C. 154(b) by 282 days.

(21) Appl. No.: 13/140,861

(22) PCT Filed: Dec. 21, 2009

(86) PCT No.: PCT/AU2009/001667

§ 371 (c)(1),
(2), (4) Date: Sep. 7, 2011

(87) PCT Pub. No.: WO2010/069009

PCT Pub. Date: Jun. 24, 2010

(65) Prior Publication Data

US 2011/0308184 A1 Dec. 22, 2011

(30) Foreign Application Priority Data

Dec. 19, 2008 (AU) ..... 2008906545

(51) Int. Cl.
*E04H 1/00* (2006.01)

(52) U.S. Cl.
USPC ..... 52/79.1

(58) Field of Classification Search
USPC ..... 52/79.1, 79.5, 79.9, 79.11, 79.14, 52/481.1, 415, 418, 421, 425, 429, 437, 52/442
See application file for complete search history.

(56) References Cited

U.S. PATENT DOCUMENTS

| | | | | | |
|---|---|---|---|---|---|
| 1,073,540 | A | * | 9/1913 | Stewart | 52/336 |
| 1,124,404 | A | * | 1/1915 | Featherstone | 52/372 |
| 1,984,180 | A | | 12/1934 | Dickson | |
| 2,353,315 | A | | 7/1944 | Maze | |
| 3,195,699 | A | * | 7/1965 | Johnston | 52/364 |
| 3,555,762 | A | * | 1/1971 | Costanzo | 52/588.1 |
| 3,557,511 | A | * | 1/1971 | Curran | 52/414 |
| 4,186,535 | A | * | 2/1980 | Morton | 52/250 |
| 4,333,280 | A | * | 6/1982 | Morton | 52/167.1 |
| 4,335,557 | A | * | 6/1982 | Morton | 52/745.05 |
| 4,882,889 | A | * | 11/1989 | Healy et al. | 52/336 |
| 5,218,803 | A | * | 6/1993 | Wright | 52/243 |

(Continued)

FOREIGN PATENT DOCUMENTS

| | | | |
|---|---|---|---|
| JP | 4203610 | A | 7/1992 |
| WO | 9406304 | | 3/1994 |
| WO | 2006/058390 | A1 | 6/2006 |
| WO | 2008094175 | | 8/2007 |

OTHER PUBLICATIONS

New Zealand Examination Report for Application No. 593348 dated Nov. 21, 2012 (3 pages).
PCT/AU2009/001667 International Search Report.

(Continued)

*Primary Examiner* — Mark Wendell
*Assistant Examiner* — Keith Minter
(74) *Attorney, Agent, or Firm* — Michael Best & Friedrich LLP

(57) ABSTRACT

A method of fixing overlaying components together, comprising the step of piercing nails having a profiled shank through the components to fix those components together. Structures including metal sheet are also disclosed which utilize this fixing technique. The structures include composite wall panels used in tilt up wall panel construction.

18 Claims, 7 Drawing Sheets

(56) References Cited

U.S. PATENT DOCUMENTS

| | | | | |
|---|---|---|---|---|
| 5,286,318 | A * | 2/1994 | Sims et al. | 156/71 |
| 5,417,023 | A * | 5/1995 | Mandish | 52/348 |
| 5,609,005 | A * | 3/1997 | Schierloh et al. | 52/699 |
| 6,151,858 | A * | 11/2000 | Ruiz et al. | 52/481.1 |
| 6,412,231 | B1 * | 7/2002 | Palatin | 52/79.1 |
| 6,622,452 | B2 * | 9/2003 | Alvaro | 52/742.14 |
| 6,631,599 | B1 * | 10/2003 | Takagi | 52/579 |
| 6,658,810 | B2 * | 12/2003 | DeLoach, Sr. | 52/701 |
| 6,688,066 | B1 | 2/2004 | Cottier et al. | |
| 6,854,230 | B2 * | 2/2005 | Starke | 52/481.1 |
| 7,114,695 | B2 * | 10/2006 | DeLoach, Sr. | 249/18 |
| 7,700,024 | B1 * | 4/2010 | Teng | 264/219 |
| 7,743,580 | B2 * | 6/2010 | DeLoach, Sr. | 52/708 |
| 7,780,894 | B2 * | 8/2010 | Jones et al. | 264/299 |
| 7,810,293 | B2 * | 10/2010 | Gibbar et al. | 52/309.7 |
| 7,823,364 | B2 * | 11/2010 | Elliott | 52/745.05 |
| 8,424,263 | B2 * | 4/2013 | Hsieh | 52/414 |
| 2004/0200168 | A1 * | 10/2004 | Takagi et al. | 52/415 |
| 2004/0221518 | A1 * | 11/2004 | Westra | 52/79.1 |
| 2005/0160693 | A1 * | 7/2005 | Dubreuil | 52/481.1 |
| 2007/0107352 | A1 * | 5/2007 | Kawai et al. | 52/481.1 |
| 2008/0313991 | A1 * | 12/2008 | Chouinard | 52/506.01 |
| 2010/0269439 | A1 * | 10/2010 | Morrisette | 52/309.4 |
| 2010/0281784 | A1 * | 11/2010 | Leo | 52/16 |
| 2011/0154747 | A1 * | 6/2011 | Kralic et al. | 52/125.2 |
| 2011/0154766 | A1 * | 6/2011 | Kralic et al. | 52/415 |
| 2011/0154768 | A1 * | 6/2011 | Kralic et al. | 52/578 |
| 2011/0232202 | A1 * | 9/2011 | Graf Fernandez | 52/79.1 |
| 2013/0081345 | A1 * | 4/2013 | Sheehy | 52/425 |
| 2013/0232899 | A1 * | 9/2013 | Bacon et al. | 52/309.1 |

OTHER PUBLICATIONS

New Zealand Examination Report for Application No. 593348 dated Jul. 17, 2012 (2 pages).

* cited by examiner

FIXING SYSTEM AND METHOD

TECHNICAL FIELD

The present invention relates to a method of fixing and to structures and assemblies utilising such fixing systems. The invention has particular application to composite panels used in tilt up wall panel construction and is herein described in that context. However it is to be appreciated that the invention is not limited to that use and for example finds application in other metal to metal fixing used in building and construction. These applications include composite decking, sheds, fences, and framing in general.

BACKGROUND OF THE INVENTION

Known pre-cast concrete tilt-up wall panels are either cast on a building site or off-site and thereafter transported to the site. In either case, once on the building site, the panels are positioned on an underlying support structure, typically a rebated concrete slab, to form the walls of the building. Thereafter, the roof of the building is constructed to complete the main structure of the building.

In International patent application WO2006/058390, the Applicant discloses a tilt-up wall panel that is in the form of a composite structure having a deck formed of one or more profiled sheets and cementitious material cast on the deck.

To assemble the deck for the panel, it is desirable to be able to interconnect the deck components together quickly and effectively. Similarly in a wall fit out using such panels described above, it is necessary to install fixtures, such as window and door fixtures, to the wall panels. These fixtures may be installed once the wall is in place or may be fitted prior to installing of the wall. In either case, it is desirable to be able to simplify the installation of these fixtures by effective joining of the fixtures to the wall panel.

SUMMARY OF THE INVENTION

According to a first aspect the present invention provides a method of fixing overlaying components together comprising the step of piercing nails having a profiled shank through the components to fix those components together.

In a particular form, the profiled shank of the nails is serrated. In one form, the nails are installed using a gas powered gun. In another form, nails are installed using other means such as other powered nail guns or manually.

The method of the invention may be used to fix components where at least one of those components is made from metal. In one form, the method is used in metal to metal fixing. In one form, the invention is used in metal to metal fixing where one of those components is formed from metal sheet.

The use of nails having profiled shanks enable the nails to engage with the metal components in such away that the nails are fixed by interaction of the profiled shank with the metal sheet. This has been found to provide a very effective fixing technique which is able to accommodate high loading. This obviates the need to rely on anchoring of the fastener behind the metal sheet (such as in a settable material in a composite structure). It also allows for perimeter or edge fastening of structures and still allows for a structural connection.

The nails can be inserted without undue movement of the components, and without requiring support from behind the fixed components. This therefore allows for full face fixing. This allows components which form part of the structure (such as decking components) as well as structural connections and other fixtures (such as window and door fixtures) to be fixed to the structure.

In one form, the method is used in wall panels made from a composite structure such as that described in International patent application WO2006/058390. The use of nails allows for rapid fixing of components (particularly where they are installed by gas firing).

In a further aspect, the present invention provides a structure formed of a plurality of components and including overlapping regions where respective ones of the plurality of components overlap one another and are secured together by nails which include profiled shanks that extend through the overlapping components.

In a particular form, the structure is in the form of a panel assembly that includes a deck which is arranged to support the casting of a settable material. In a particular form the deck is formed from at least one metal sheet, the or each sheet having opposite ends and opposite sides that extend between the ends, and being profiled to incorporate one or more stiffening formations.

In one form, one of the components of the structure is made from sheet steel that incorporates a corrosion resistant metal coating. An example sheet steel is sold by the Applicant under the trade name ZINCALUME. The sheet material may be provided in coils so that the sheet is in a continuous length and then cut to size to form the sheet. In a particular form of this application, the formations extend longitudinally in the direction of the sheet strip.

In one embodiment, the structure comprises a deck having a plurality of decking sheets each having an intermediate section and side margins that are turned out of the intermediate section and form respective stiffening formations for that sheet, the side margins of adjacent sheets being arranged to inter-engage. In a particular form, the deck is used in a composite structure and stiffening formations are configured so that they do not significantly deform on casting of the settable material onto the deck which would otherwise make it more difficult to maintain dimensional control of the resulting panel.

In yet a further aspect, the present invention provides a wall panel having a layer of hardened settable material at least one opening contain a wall fixture, the opening being defined at least in part by at least one edge member that incorporates a first face that defines an edge of the opening and wherein the wall fixture is secured to said edge member at said first face by a plurality of nails having profiled shanks that extend through said edge member and said wall fixture.

In a particular form the hardened settable material is cementitious.

In one form, the wall panel further comprises at least one region disposed behind the first face that has a material density less than the hardened settable material. The purpose of this less dense region is to receive the nails having the profiled shanks and to obviate the need to locate the fasteners into the hardened settable material which may be problematic if that material is concrete or the like.

In one form, the less dense region forms part of the edge member. For example the edge member may be formed from timber and the fastener is arranged to be fixed to the timber. In another form, the edge member may be a hollow metal section or may be otherwise formed with voids.

In yet a further form, the invention is directed to tilt-up wall panel for use in the construction of a building, the panel comprising a composite wall panel according to any form described above.

In another form, the structure is made of metal components. Examples of such structures include sheds, fences, decking and cladding systems.

DESCRIPTION OF THE FIGURES

In order to achieve a better understanding of the nature of the present invention embodiments will now be described, by way of example only, with reference to the accompanying figures in which.

DETAILED DESCRIPTION OF EMBODIMENTS

Figure 1:
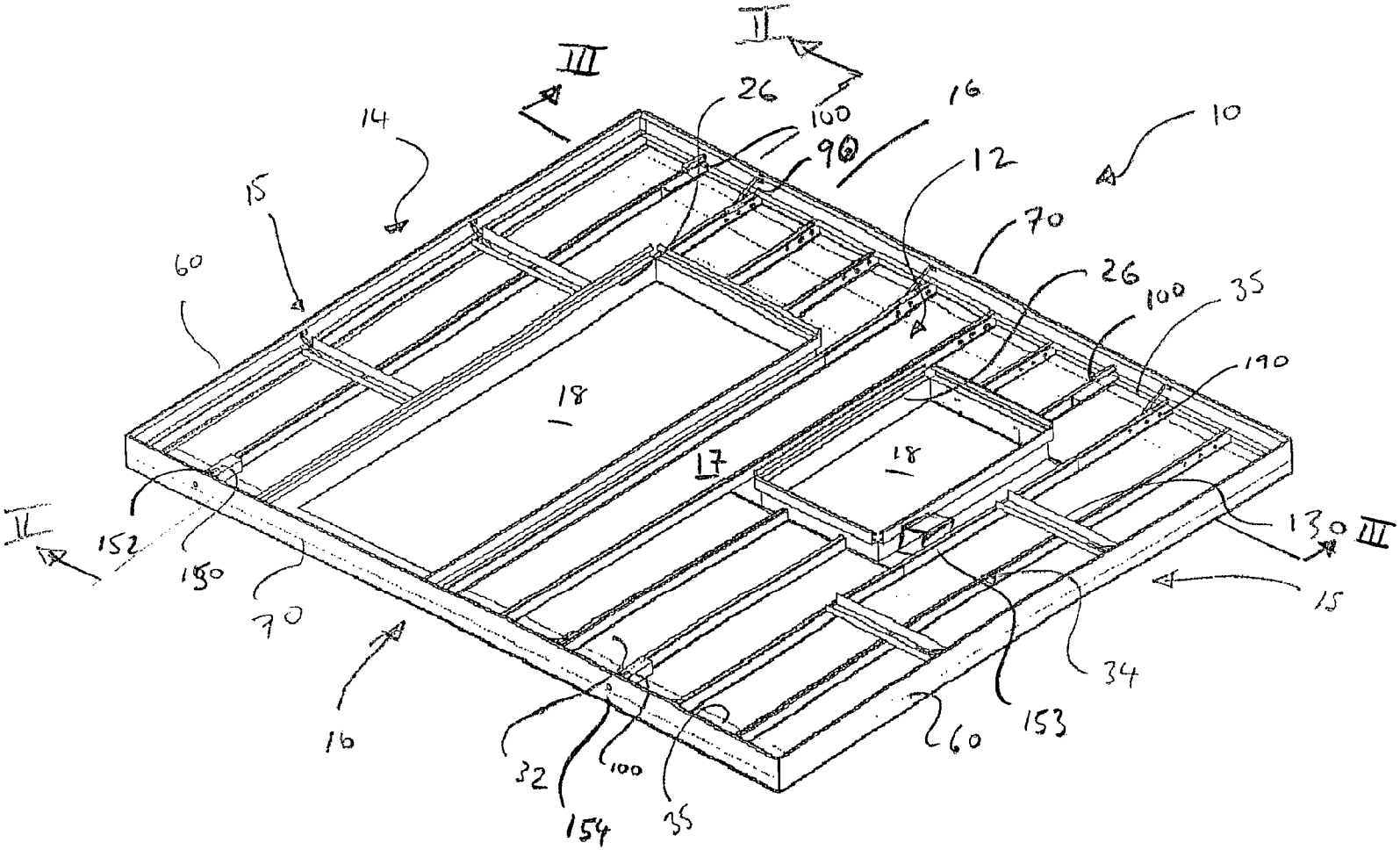
FIG. 1 is a schematic perspective view of a panel assembly for a composite wall panel.
Figure 2:
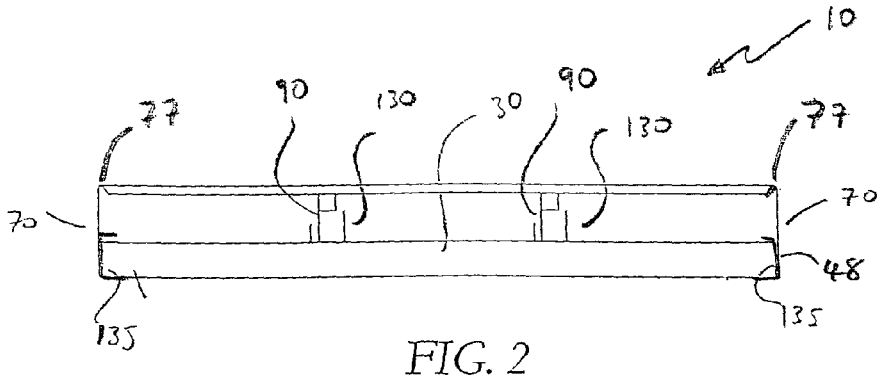
FIG. 2 is a section view along section lines II-II of the assembly of FIG. 1.
Figure 3:
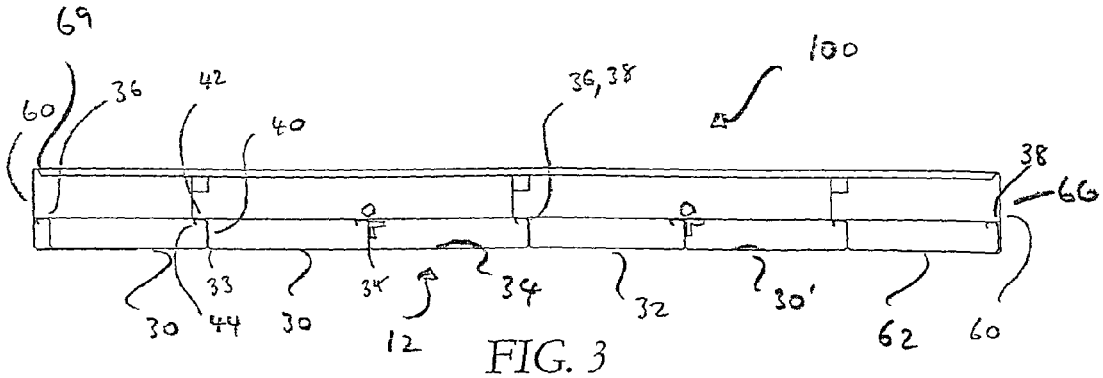
FIG. 3 is a section view along section lines of the assembly of FIG. 1.
Figure 10:
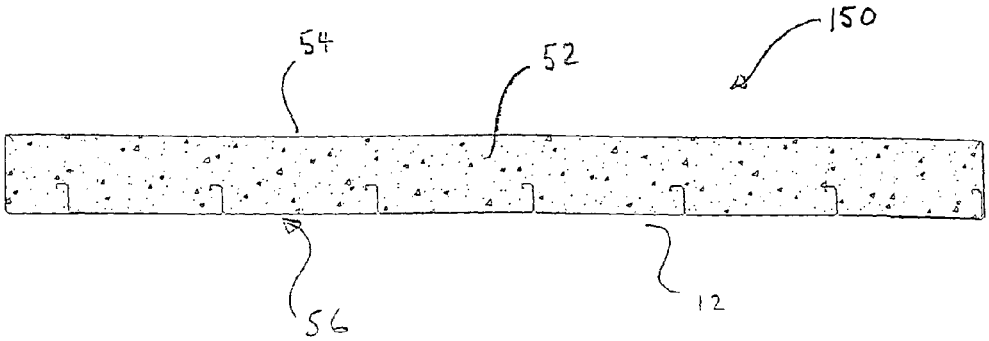
FIG. 10 is a section view of a composite panel formed using the panel assembly of FIG. 1.

Turning firstly to FIGS. 1 to 3, a panel assembly 10 is disclosed which is arranged to form part of a composite structure 50 (see FIG. 10). The panel assembly includes a deck 12 and a peripheral edge 14 that extends around the deck and defines a cavity 17 which is arranged to receive a settable material 52. The settable material is typically cementitious (such as concrete) and the resulting composite structure 50 comprises the panel assembly 10 and the hardened layer 52 of the cementitious material. The components are intimately connected as is described in more detail below so that the panel assembly 10 provides reinforcing to the cementitious layer 52.

Figure 11:
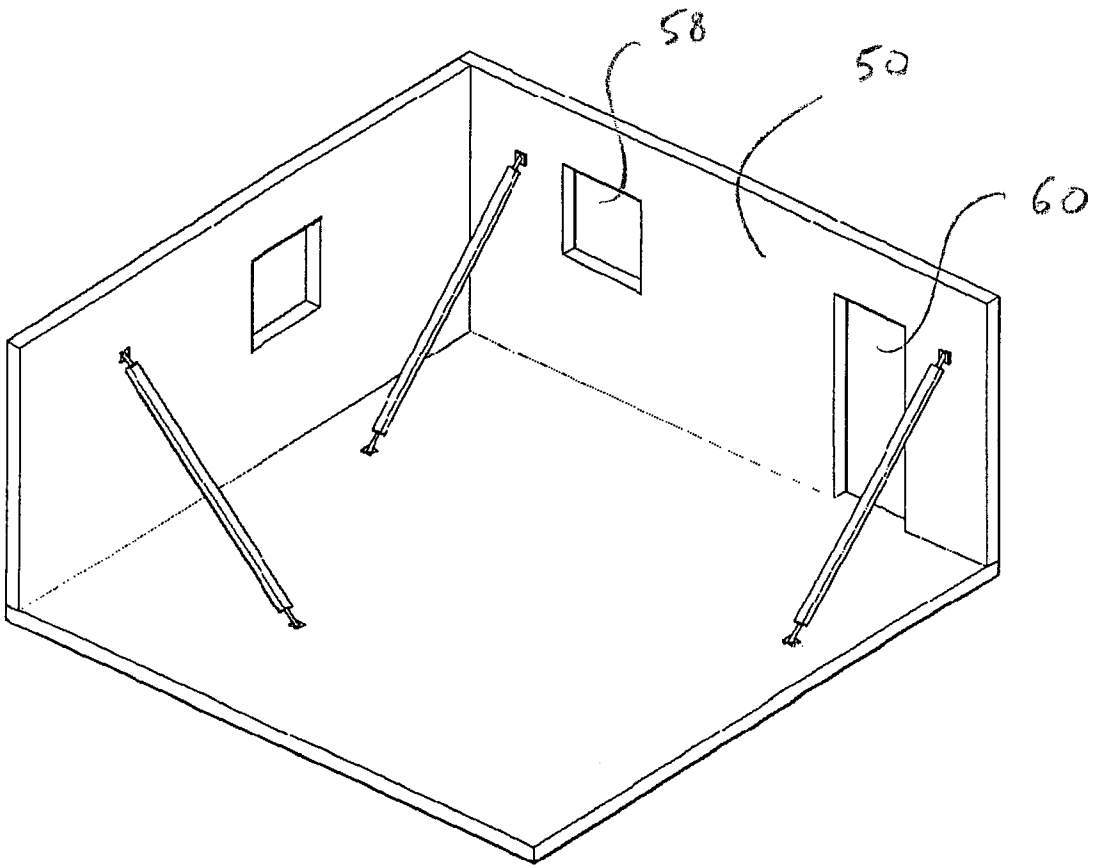
FIG. 11 is an illustration of the composite panel of FIG. 10 in use as a tilt-up wall panel in a building.

In the illustrated form, the resulting composite structure 50 utilising the panel assembly 10 is designed for tilt-up construction where the structure 50 forms a wall panel of a building 100 (see FIGS. 11 to 15). In a first stage of construction of the building 100 the composite structure 50 is formed by casting of the cementitious layer 52 onto the panel assembly 10 whilst it is laid out in a horizontal configuration. After curing of the cementitious layer, the panel 50 is then "tilted up" into a vertical orientation as best shown in FIG. 11 using lifting apparatus such as a crane. Typically one side 54 of the composite panel 50 which includes the exposed concrete face forms an external surface of the building 100 whereas the other side 56 which incorporates the metal decking as an exposed face forms the internal surface of the wall. When the composite panel 50 is in its correct vertical orientation, the wall can then be fitted out by fixing various components to that composite structure such as internal battens 102, facing sheets (such as internal plasterboard sheeting) 104 and window and door fittings (generally given reference numeral 106 and 108) as shown in FIGS. 12 to 15 and as will be described in more detail below.

The panel assembly 10 includes, in addition to the peripheral edge 14, one or more opening 18, and internal edge members (26, 28, 29) (see FIGS. 6, 7 and 8) that surround the openings. The incorporation of the openings and internal edge members is designed to provide the window and door openings (58, 60) in the resulting composite panel 50 which in turn are arranged to receive the associated window and door fixtures 106 and 108. The panel assembly 10 is made up of standard components which are designed to allow for flexibility in the dimensions of the panel assembly and the position and size of the openings thereby providing flexibility in the layout of the resulting panel 50.

The deck 12 of the panel assembly 10 is formed from a plurality of profiled sheets 30 arranged in side by side relationship to create at least the majority of the deck 12 of the panel assembly 10. For convenience, in the following description the references numerals of profiled sheets 30 are sometimes referred to with superscript (I) to allow for identification of particular sheets within deck 12. In other instances where the description is more general, the reference numerals are provided without any superscripts.

The profiled sheets 30 have an intermediate section 32 which in one form may include stiffening formations 34 that extend along the sheet. The profiled sheets 30 also include opposite ends 35 and longitudinally extending side margins 36 and 38 that are turned out of the intermediate section 32. The side margins 36, 38 are arranged to inter-engage with the opposite side margin of an adjacent profiled sheet 30 so that the decking 12 is continuous. Furthermore, the side margins 36, 38 inter-engage so as to resist lateral expansion under loading of the panel which occurs on casting of the cementitious layer 52.

Typically, each of the side margins include a web 40 that extend from the intermediate section 32, a flange 42 that extends from a distal end of the web 40 and a lip return 44. One side margin 36 is nested in the other side margin 38 of an adjacent sheet with the respective flanges 42 and webs 40 in abutting relation.

The profiled sheets 30 are typically formed in standard widths are made from sheet steel that incorporates a corrosion metal coating. Example sheet steel is sold by the applicant under the trade name ZINCALUME. The sheet material may be provided in coils so that the sheet is profiled in a continuous length and then cut to size to form individual profiled member sheets 30. In a particular form the profiling of the sheets is done by cold forming such as by passing the steel strip through one for more roll formers. In this arrangement the side margins 36, 38 and the stiffening formations 34 extend longitudinally in the direction of the steel strip.

Typically in use the resulting composite panel 50 when in its final orientation as a wall has a horizontal dimension which is longer than the height or vertical dimension of the structure. As such, the panel assembly 10 (and resulting structure 50) have "short" sides 15 that are arranged to extend vertically, and the "long" sides 16 that extend horizontally. With the orientation, the individual profiled sheets 30 are orientated so that the side margins extend generally parallel to the short side 16. While the long side is usually of greater length than the short side, the panel assembly is not limited to that arrangement and as such the terms "long" and "short" are used for descriptive convenience and are not be construed to limiting the invention to particular dimensional relationships.

Figure 4:
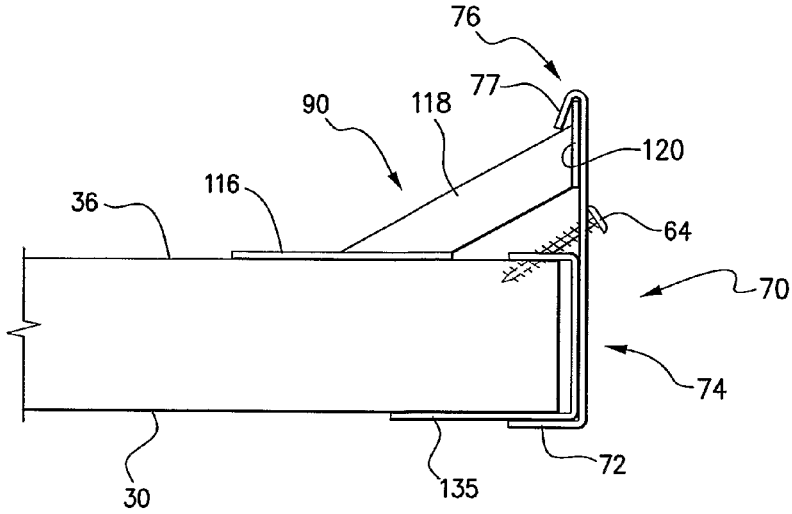
FIG. 4 is a detailed view to an enlarged scale of the long peripheral edge construction in the assembly of FIG. 1.
Figure 5:
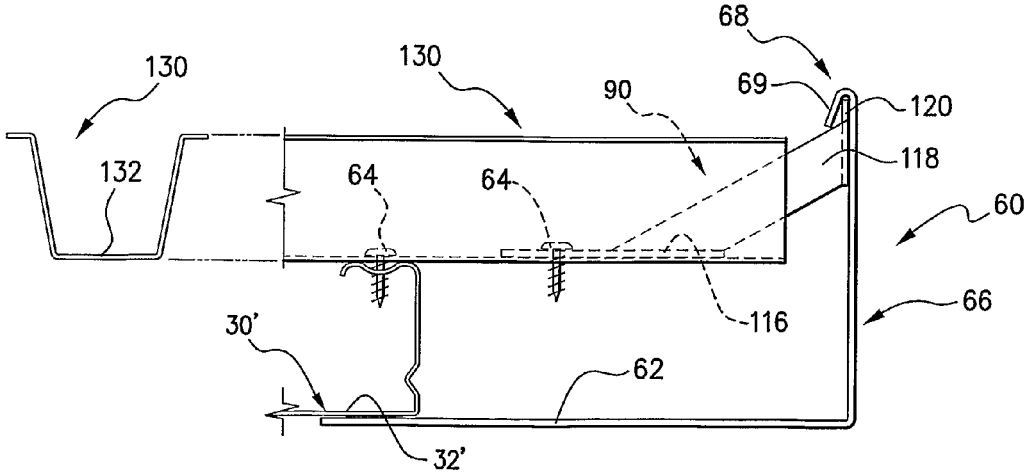
FIG. 5 is a detailed view to an enlarged scale of the short peripheral edge construction in the assembly of FIG. 1.

The peripheral edge 14 of the panel assembly 10 is typically formed from separate members, being in the illustrated form, short side edge members 60 (as shown in FIG. 5) which extend along the short side 15 of the panel and long side edge members 70 (as shown in FIG. 4) which extend along the long side 16.

The panel assembly also includes a plurality of connectors 150 which are disposed along the opposite long sides 16 of the assembly 10 and which are fixed to the deck 12. In the illustrated form, the connectors are fixed to overlapping side margins 36, 38 of interconnected sheets 30, typically in webs 40. In use the connectors are arranged to be largely embedded within the cementitious layer 52. In the illustrated form the connectors include a coupling portion 152 which is arranged to form one part of a load bearing coupling, wherein loading induced at the coupling is arranged to be transferred through the connector to the deck. In the illustrated form, the coupling portions 152 include a threaded passage which opens to long sides 16 of the panel assembly 10 through holes 154 formed in the side members 70.

The connectors 150 are arranged to be fixed to the deck 12 rather than being solely embedded in the partially or fully hardened material, as is the case in traditional concrete tilt up panels. This allows for loading across the resulting coupling to be transferred to the element which can be better placed to accommodate that loading particularly when it is in a direction that induces a pull out force on the connector as is the case when the coupling connector the panel to lifting equipment to tilt the panel up into place. This arrangement has particular application where the settable material may be of relatively low strength, such as low strength concrete, as the strength of connection can be greatly increased over what would otherwise been provided if the connector was merely embedded in the concrete layer. A further advantage is that the minimum pull out force for the element is able to be relatively easily calculated which allows the system to be inherently safer.

The connectors may be used in various ways. In one form, the connector(s) may be used as lifting points for the panel in say a tilt up panel arrangement. In another form, the connectors may be used to fasten the panel to a structure such as a floor slab and/or a roof truss. In another form, a plurality of connectors may be provided that are spaced apart. The connectors may be used to load the element (say by pre tensioning the element prior to casting of the material or to post tension that element) so as to prestress the resulting composite panel.

To allow variation in the size of the panel assembly and resulting composite panel 50 using that panel assembly 10, it is desirable that both the length of the short side 15 and the long side 16 of the resulting panel assembly 10 can be varied. Because the individual sheets 30 that make up the deck 12 extend in the direction of the short side 15, that dimension can be easily adjusted by merely varying the length of the individual sheets 30 that make up the basis of the panel deck 12. As mentioned above, the sheets 30 are typically formed from continuous strip and this length can be easily changed by changing the cut length of the individual sheets. In contrast, it is more difficult to provide variation in the length of the long side 16. As the individual sheets 30 are typically of standard width (e.g. between 300 and 500 mm) the addition or removal of individual sheets 30 only provides a mechanism to change the dimension of the long side by increments of the width panel (e.g. typically in increments of 300 to 500 mm).

To provide more incremental change in the dimension of the long side 16, the short side member 60 is provided with an extended tail portion 62 (as best illustrated in FIG. 5) and an upstanding edge portion 66. The edge portion 66 forms part of the peripheral edge 14 and the tail portion 62 is arranged to underlap the endmost profiled sheet $\mathbf{30}^1$ so that at least part of the tail portion 62 forms an extension of the deck 12. Prior to fixing, the short side member 60 is located in its desired position to establish the required extension of the deck 12 and this extension can be varied by increasing or decreasing the amount the tail portion 62 underlaps the profiled sheet 30. This therefore gives a mechanism to provide relatively fine adjustment of the dimension of the long side 16 of the panel 10.

A long side edge member 70 is arranged to be located in close proximity to each of the respective ends 46 and 48 of the deck 14 as there is not the same requirement for the long side member 70 to provide significant adjustment in the dimension of the panel as is the case with the short side member 60 as discussed above. The long side member 70 typically extends the entire length of each end 46, 48 of the deck 12 and, as best illustrated in FIG. 4, includes a short tail portion 72 which underlaps the ends 35 of the profiled sheets 30 which form the respective ends 46, 48 of deck 12. The long side members 70 include an upstanding edge portion 74 which extends up from the tail portion 72 and which forms part of the peripheral edge 14. Fine adjustment can still be made at the long side 16 by positioning of deck within the long side member 70.

As best illustrated in FIGS. 4 and 5, the upstanding edge portions 66, 74 of the respective side members 60, 70 are arranged to extend above the side margins 36, 38 of the sheet members 30. The height of these side margins define the maximum depth of the cementitious layer which is arranged to be cast on to the deck 12. As such the side margins 36, 38 of the respective profiled sheets 30 are arranged to be fully embedded within the concrete layer 52 as best illustrated in FIG. 10.

In addition, in the illustrated form, distal ends 68, 76 of the side members 60, 70 are arranged to have a re-entrant lips 69, 77. These lips 69, 77 are arranged to become embedded within the concrete layer as best shown in FIG. 10. This is beneficial as it assists in maintaining the integrity of the resulting structure as it inhibits edge peeling. A secondary function of these lips 69, 77 is to receive a support bracket 90 as will be described in more detail below.

Figure 6:
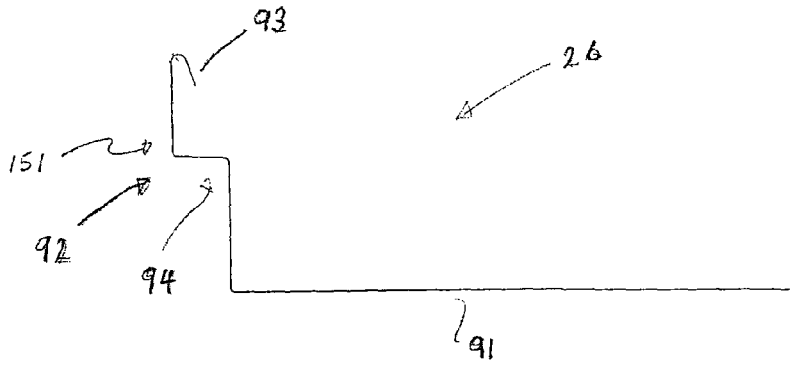
FIG. 6 is a detailed view of the profile of an internal side edge member for the assembly of FIG. 1 for a window or door opening.

The internal edge members 26, 28 and 29 (illustrated in FIGS. 6, 7 and 8) function in a similar way to the long and short side members 60, 70 as disclosed above. In particular, the internal side member 26 illustrated in FIG. 6 is arranged to allow adjustment of location and/or width of the opening (i.e. in the direction of the long side 15) in the same way as the short side member 60 is able to provide an extension to the length of the deck 12. In particular, the internal side member 26 includes an extended tail portion 91 and an upstanding edge portion 92. The tail portion is arranged to locate under the profiled sheet 30 adjacent the opening and the amount of underlap between the deck and the tail portion can be varied thereby varying the width of the door or window opening. With this arrangement, an open region (generally designated 150) can be provided in the deck merely by omitting or removing a section of one or more profiled sheets 30. This approach creates the open region 150 in the deck which has a width equal to the width of the profiled sheet (typically being 300 to 500 mm as described above) multiplied by the number of sheets omitted or removed. The size and position of the open region 150 is adjusted by positioning the internal side edge members 26 at one or more sides of the opening and adjusting the amount the rail portion 92 laps with the deck 12 thereby allowing a great deal of flexibility in both the location and size of the opening.

The upstanding edge portion 92 of the internal side member 26 also includes the inwardly turned lip 93 which functions in the same way as the lips 69 and 77 in the side members 60, 70. In particular these lip returns 93 are arranged to become embedded within the concrete layer and also to receive a support bracket 90 if required.

A feature of the side member 26 is that the edge portion 92 has profiled face 151 which defines an edge of the opening. In the illustrated form, the face 151 is stepped so as to incorporate a rebate 94 along that face. The purpose of that rebate 94 is to allow easy fixing of the window and door components as will be described below. Void former, such as polystyrene blocks 153 may be installed behind the edge members 26, 28, 29 to provide a less dense region to allow fixing of fasteners into the members.

Figure 7:
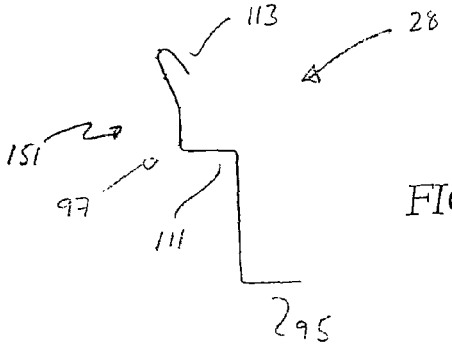
FIG. 7 is a profile of an internal top edge member for a window or door opening in the assembly of FIG. 1.
Figure 8:
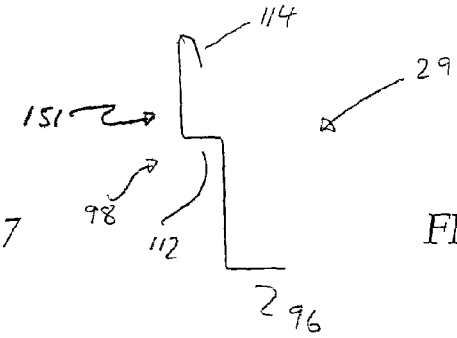
FIG. 8 is a detailed view of the profile of an internal edge member for the assembly of FIG. 1 for use in a window sill.

FIGS. 7 and 8 illustrate the top and bottom edge members 28, 29 respectively. Both these edge members include short tail sections 95, 96 and upstanding edge portions 97, 98. Further, the edge portions 97, 98 are profiled in a similar manner to the edge portion 92 of the side member 26 so as to form a rebate 111 and 112. Further each of the top and bottom internal edge members 28, 29 include the lips 113, 114 at the distal end of the edge portions 97, 98. The lip 113 on the top edge member 28 is modified so as to extend outwardly so as to provide a drip groove in the resulting opening. The lip 114 of the bottom edge member is of similar structure to the lip return 93 in the internal side member 26.

Figure 9:
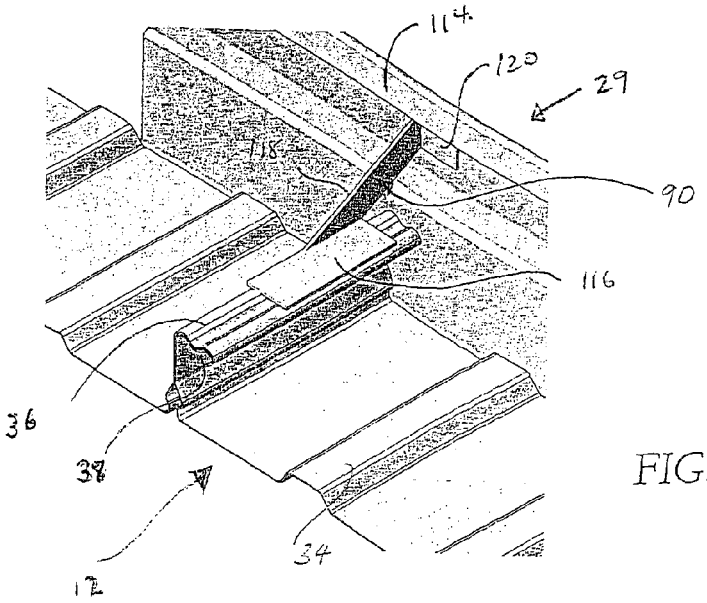
FIG. 9 is a detailed perspective view of the internal top edge member and a support bracket in the assembly of FIG. 1.

As indicated above, the incorporation of the lips 77, 93, 113 and 114 in the internal and external edge members 60, 70, 26, 28 and 29 are utilised not only to embed those edge members in the concrete layer but are also provided to receive and positively lock a support bracket 90 as best illustrated in FIGS. 4, 5 and 9.

The support bracket 90 includes a base 116, a web 118 which is angled outwardly from the base 116 and a flange 120 which extends upwardly and outwardly from the web portion 118.

The flange 120 is arranged to locate under the lip return and the base 116 is arranged to be brought down so as to either locate on a side margin 36 and 38 as best illustrated in FIG. 9 when fitted to the long side 15 or onto a bridging member 130 which extends perpendicularly across the side margins when fitted to the short side 16. In the illustrated form of FIG. 5, the bridging member comprises an inverted top hat section 130 where the bracket base locates within the base portion 132 of the section 130. In either case, to secure the bracket, a fastener is only required to extend through the base 116 into the deck. No additional fastener is required to secure the flange 120 to the edge member (26, 28, 29, 60, or 70). The interaction of the flange with the lip return is sufficient to allow the bracket to support the edge portions of the edge members so that they are better able to accommodate the hydrostatic pressures which are induced on casting of the cementitious layer 52. Accordingly the bracket 90 is effective and simple to install.

To provide additional stiffness to the panel assembly 10 additional stiffening members may be secure to the panel assembly 10. One or more of these stiffening members may extend transverse to the stiffening formations in the profiled sheets (that is generally transverse to the short side 16). In one form, the stiffening members may overlay the side margins 36, 38 of the stiffening formations. One example of such a stiffening member is the bridging member 130 disclosed above. Another form of stiffening member is arranged to be located along the long side 15 and is best shown in FIG. 4. In that arrangement a channel section 135 is provided that locates over the ends 35 of the profiled sheets. The channel is wide enough so that it can receive the side margins 36, 38. The long side edge member 70 then locates over the channel section 135 and is fixed to both the channel 135 by a fastener which in turn is fixed to the profiled sheets 30.

The channel 135 provides rigidity to the panel assembly 10 along the long side and in particular inhibits bowing of the deck about that long side. As the profiled stiffening formations extend in the direction of the short side 16, they provide rigidity against bowing about the short side but do not significantly contribute to the rigidity along the long side. The other stiffening members (such as top hat section 130) also contribute to the rigidity of the deck 12 about this long side.

In the illustrated form, the various components of the panel assembly as well as fixtures mountable to the resulting structure (such as the window and door fixtures) are fixed using nails 64 having a profiled shank which is preferably serrated. The profiling of the shank enables the nails to interact with the metal sheets thereby taking advantage of the strength of the steel panel assemblies in the composite structure. As such less reliance needs to be placed on the strength of the settable material for the fixing of components and the engagement of the fasteners with that settable material.

The nails can be applied using a gas fired nail guns which provide a very fast, effective and inexpensive installation technique. Further gas fired nailing does not require special licences to operate and is more energy efficient and safer than power actuated nailing techniques. One such suitable nailing system is provided by ITW Buildex and sold under the trade name of GYP-FAST. Suitable profiled nails are also provided by ITW Buildex under the trade name TEKS PIN.

Importantly such fixing techniques overcome or at least substantially ameliorate the problems associated with trying to secure overlapping metal components together using Tech screws or the like where it is difficult to obtaining thread engagement across all layers, and a tendency for the overlaying components to separate resulting in poor quality connections. This can lead to a loss of accuracy in the panel dimensions due to components separating, slow and difficult installation where it is necessary to hold components and apply force to the fastener for each connection. Also such techniques are considerably more expensive than the nailing process described above.

Accordingly, a panel assembly 10 is provided that includes profiled sheets having stiffening formations formed along the side margins of the individual profile panels 30 which, in conjunction with transverse stiffening members, provides a relatively rigid deck that is able to resist bowing in both the short and long sides of the panel. The panel assembly defines a cavity 17 which is arranged to receive a settable material and contain that settable material within the panel. The panel further includes internal and external edge members that are supported and are able to withstand the hydrostatic pressures induced on casting of a settable material such as concrete and which are profiled to receive and/or form part of fixtures which are contained in the opening defined by the edge members. The various components can be manufactured separately and quickly assembled together using gas fired nails with serrated shanks for the majority if not all the fastening. In some instances other fastening techniques using tech screws, bolts or adhesives may also be used if desired.

On casting of the cementitious layer 52 a composite panel is formed which benefits from the combined action of the steel and concrete. In one form, additional reinforcement (not shown) such as mesh reinforcement may be located in the cavity to provide additional strength to the composite panel 50. In other form, the need for the additional reinforcement may be obviated by the use of the additional stiffening members (such as top hat sections 130 and channel 135) of the panel assembly itself may be sufficient. In either case no portion of the panel assembly 10 is required to be stripped after casting thereby maximizing the material use and simplifying the construction process.

The resulting composite panel 50 is ideally suited for tilt up wall system.

Figure 12:
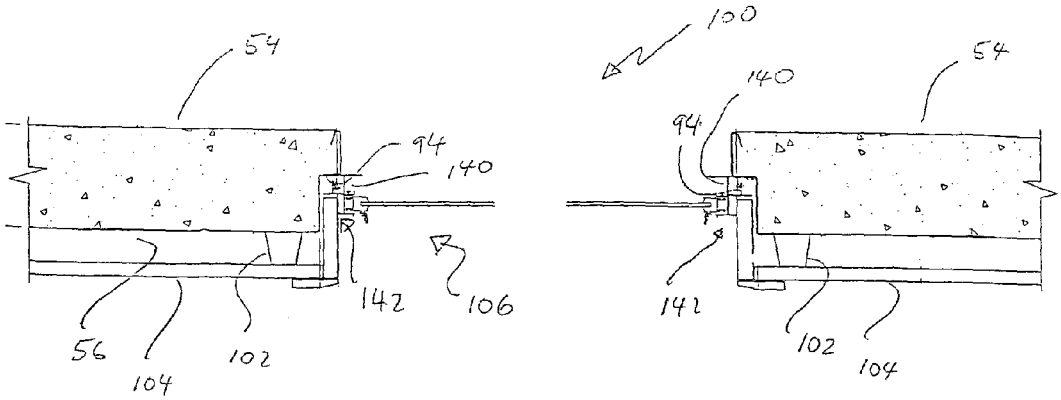
FIG. 12 is a horizontal section of a window in a building incorporating the composite panel of FIG. 10.
Figure 13:
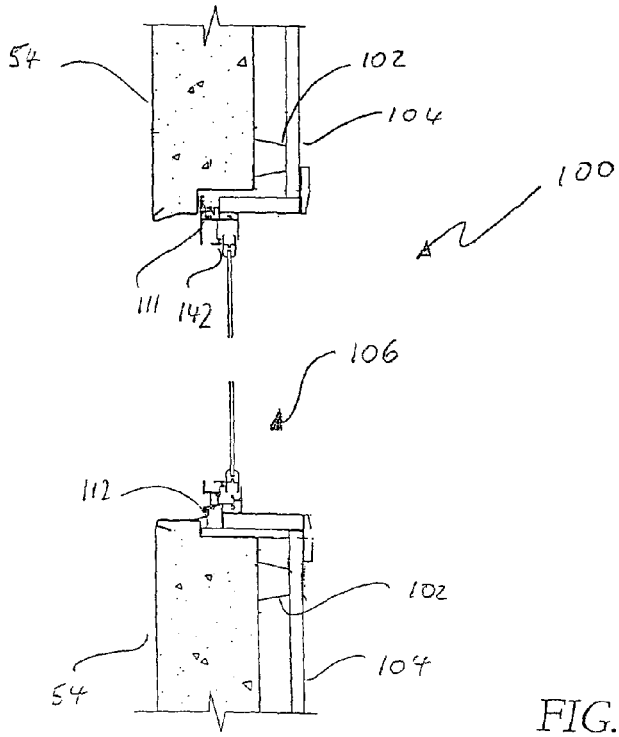
FIG. 13 is a vertical section of the window of FIG. 12.
Figure 14:
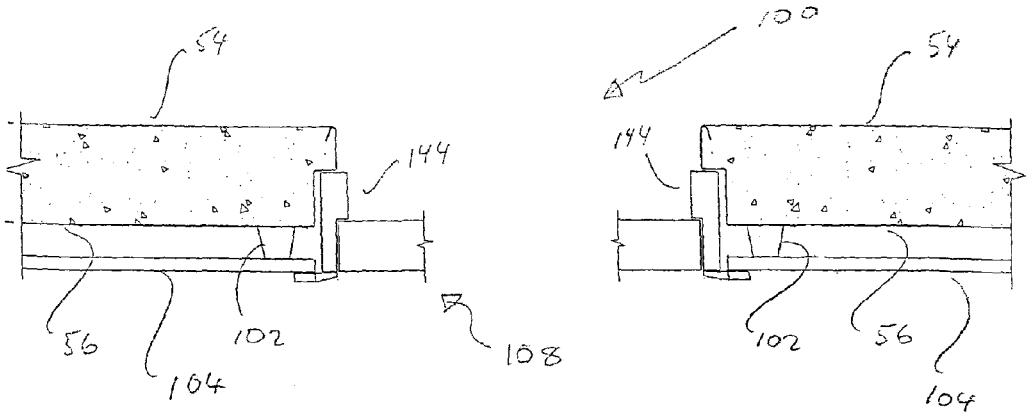
FIG. 14 is a horizontal section of a door in a building incorporating the composite structure of FIG. 10.
Figure 15:
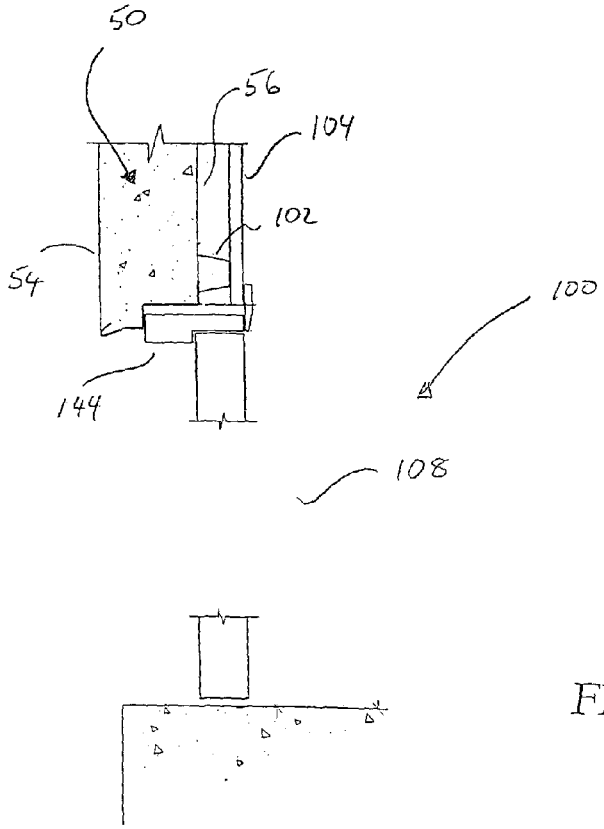
FIG. 15 is a vertical section of the door of FIG. 14.

As best illustrated in FIGS. 12 to 13, once composite panel 50 in place all fixing details such as battens 102 and internal window and timber fixings 106 and 108 can be fixed directly to the steel paneling. Moreover window details can be fixed directly into the rebates 94, 111, and 112 formed on the internal edges of the openings thereby allowing direct placement of those components without requiring any variation in the openings formed within the concrete structure 50. In particular, the seal details 140 and window and door profiles 142, 144 sit directly within the rebates formed on those components and can merely be slotted in and fixed in place by the serrated nails 64.

Advantages of the panel assembly 10 and composite structure 50 are:

1. The panel assembly defines a cavity 17 which is arranged to receive a settable material and contain that settable material within the panel. The panel further includes internal and external edge members that are supported and are able to withstand the hydrostatic pressures induced on casting of a settable material such as concrete. No additional jigs or supports are required so that the assembly lends itself for on site casting of the settable material;

2. The panel assembly includes profiled sheets having stiffening formations formed along the side margins of the individual profile panels which, in conjunction with transverse stiffening members, provides a relatively rigid deck that is able to resist bowing in both the short and long sides of the panel;

3. No portion of the panel assembly is required to be stripped after casting thereby maximizing the material use and simplifying the construction process;

4. The use of purpose shaped internal edge members that form rebates, drip grooves and the like reduces the need for post forming of the wall panels after casting. Internal fit out elements, such as door and windows fixing details can be fitted directly in place;

5. The edges of the cementitious layer are protected by the panel edge members which in turn are partially embedded in the cementitious layer, thereby enhancing the integrity of the composite panel and providing protection for the cementitious edges during installation;

6. The use of common components, such as profiled sheets, brackets edge members, which are all engineered simplifies the construction of the panel assembly; and 7. The use of serrated nails to fix components together provides a fast inexpensive fixing technique that takes full advantage of the steel strength by fastening to the steel, and allows the panel assembly to provide for face fixing of components (such as battens, window and door fixtures and the like) to the panel assembly when installed as a composite wall panel.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. For example, the profiled sheets may not be cold formed but rather cast or moulded. The profiled sheet may not be made of sheet material, but may be instead a relief profile formed in a bulk material. The profiled panel may not be made of sheet metal but rather a composite such as a carbon fibre composite or a polymer. The present embodiments are, therefore, to be considered in all respects as illustrative and not restrictive.

The invention claimed is:

1. A tilt-up wall panel comprising a composite panel assembly comprising:

a deck formed from a plurality of metal sheets, and a layer of hardened settable material cast on the deck;

the deck forming part of the panel assembly and the sheets having opposite ends and opposite sides that extend between said ends, each sheet having an intermediate section and side margins that are turned out of the intermediate section and form stiffening formations that extend between the opposite ends;

the panel assembly further comprising a peripheral edge that extends around the deck and which is formed from one or more side members, each side member formed of a separable piece of material;

the deck and the edge forming a cavity arranged to receive the settable material cast on the deck to form the composite panel; wherein:

the side margins of adjacent sheets overlap and are fixed together by nails having profiled shanks that extend through the overlapping side margins.

2. A tilt-up panel according to claim 1, wherein the one or more side members lap with the deck and are fixed to the deck by said nails having said profiled shanks.

3. A tilt-up panel according to claim 1, wherein the deck incorporates an open region and at least one edge member is disposed at the open region, and a first face of the edge member defines an edge of an opening in the resulting composite panel formed on casting the settable material on the deck.

4. A tilt-up wall panel according to claim 3, wherein the at least one edge member is formed of sheet material.

5. A tilt-up wall panel according to claim 3, wherein the edge member incorporates a base portion and an edge portion that upstands from the base portion, the upstanding edge portion incorporating the first face and the base portion laps with the deck and is fixed to said deck by a plurality of nails having profiled shanks.

6. A tilt-up panel according to claim 3, wherein the opening contains a wall fixture and the wall fixture is secured to said panel edge member at said first face by a plurality of nails having profiled shanks, that extend through said edge member and said wall fixture.

7. A tilt-up wall panel according to claim 6, wherein the hardened settable material abuts at least a portion of a second face of side members which is opposite said first face and said nails extend into said hardened settable material.

8. A tilt-up wall panel according to claim 6, wherein the first face is profiled to include a rebate arrangement to receive said wall fixture.

9. A tilt-up wall panel according to claim 6, wherein said wall fixture is a window or door fixture.

10. A tilt-up wall panel according to claim 3, further comprising at least one region disposed behind said first face and having a material density less than the hardened settable material and which incorporates a leading end of said profiled nails therein.

11. A tilt-up wall panel according to claim 10, wherein the less dense region forms part of said edge member or is disposed behind said edge member.

12. A tilt-up wall panel according to claim 1, wherein the nails have a serrated profile.

13. A tilt-up wall panel according claim 1, wherein the panel assembly further comprises one or more edge support members that interconnect the side and/or edge member and the deck to support the edge member in accommodating hydrostatic forces on casting of the settable material on the deck.

14. A tilt-up wall panel according to claim 13, wherein at least one of the side support members is fixed to the deck by one or more nails having profiled shanks.

15. A tilt-up wall panel according to claim 1, wherein at least one of the side support members is in the form of a bracket.

16. A tilt-up wall panel according to claim 15, wherein the edge portion of the side includes an inwardly direct lip and the bracket includes a leading end that locates under the lip and has tail portion that is fixed to the deck.

17. A tilt-up wall panel according to claim 1, wherein the hardened settable material is cementitious.

18. A tilt-up wall panel according to claim 1, wherein each separable piece of material is sheet metal.

* * * * *

UNITED STATES PATENT AND TRADEMARK OFFICE

CERTIFICATE OF CORRECTION

PATENT NO. : 8,677,696 B2
APPLICATION NO. : 13/140861
DATED : March 25, 2014
INVENTOR(S) : Brad Stewart Ryan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 361 days.

Signed and Sealed this
Twenty-ninth Day of September, 2015

Michelle K. Lee

Michelle K. Lee
*Director of the United States Patent and Trademark Office*